United States Patent [19]

Schilling

[11] Patent Number: 4,738,309

[45] Date of Patent: Apr. 19, 1988

[54] GAS/LIQUID OR GAS/GAS EXCHANGER

[75] Inventor: Heinz Schilling, Kempen, Fed. Rep. of Germany

[73] Assignee: Heinz Schilling KG, Kempen, Fed. Rep. of Germany

[21] Appl. No.: 775,849

[22] Filed: Sep. 13, 1985

[30] Foreign Application Priority Data

Sep. 13, 1984 [DE] Fed. Rep. of Germany ..... 3433598

[51] Int. Cl.[4] ..... F28F 9/26

[52] U.S. Cl. ..... 165/144; 165/101; 165/76

[58] Field of Search ..... 165/76, 78, 144, 101

[56] References Cited

U.S. PATENT DOCUMENTS

| | | | |
|---|---|---|---|
| 1,123,765 | 1/1915 | Lawler | 165/101 X |
| 1,899,629 | 2/1933 | Morse | 165/144 X |
| 1,901,090 | 3/1933 | Eule et al. | 165/144 X |
| 1,926,719 | 9/1933 | Gibb, Jr. et al. | 165/144 X |
| 2,044,069 | 6/1936 | Erbach | 165/144 |
| 2,217,410 | 10/1940 | Howard | 165/144 X |
| 2,237,239 | 4/1941 | Smith | 165/144 X |
| 2,354,131 | 7/1944 | Larkin | 165/144 X |
| 2,505,790 | 5/1950 | Panthofer | 165/144 X |
| 2,512,560 | 6/1950 | Young | 165/144 X |
| 3,783,936 | 1/1974 | Wisz | 165/101 |
| 4,367,789 | 1/1983 | Moranne | 165/76 |

FOREIGN PATENT DOCUMENTS

| | | | |
|---|---|---|---|
| 74090 | 9/1945 | Denmark | 165/101 |
| 43378 | 8/1887 | Fed. Rep. of Germany | 165/101 |
| 619896 | 3/1961 | Italy | 165/101 |

*Primary Examiner*—Albert W. Davis, Jr.
*Assistant Examiner*—Peggy Neils
*Attorney, Agent, or Firm*—Karl F. Ross; Herbert Dubno

[57] ABSTRACT

A heat exchanger is formed by selectively stacking an appropriate number of functionally independent and discrete heat exchange panels, each of which is a complete heat exchanger in its own right with a set of vanes and two flow passages in indirect heat exchange relationship through said vanes.

4 Claims, 4 Drawing Sheets

Fig.1
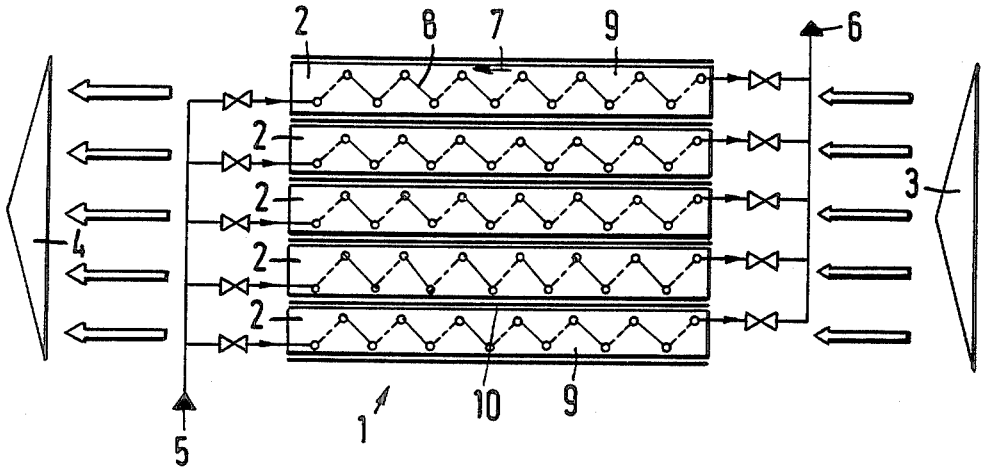
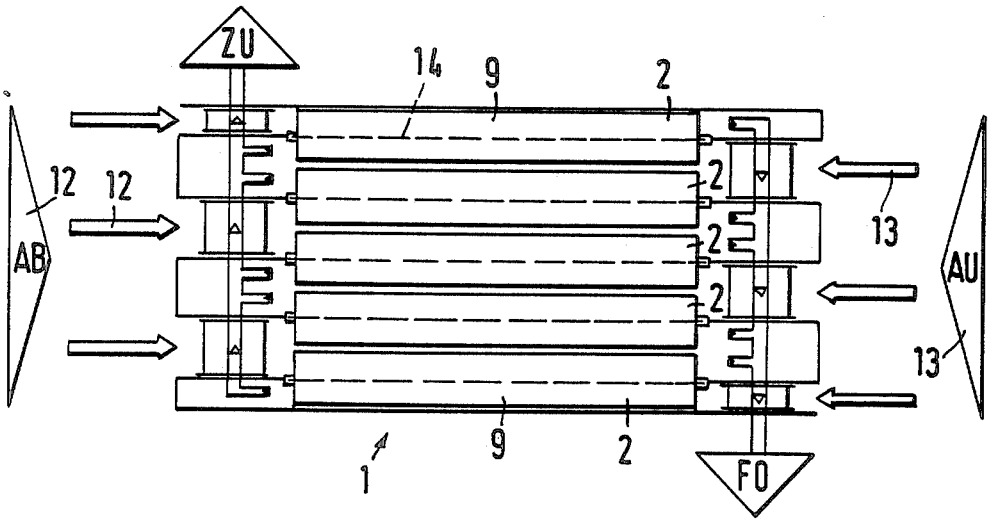
Fig.3

GAS/LIQUID OR GAS/GAS EXCHANGER

FIELD OF THE INVENTION

My present invention relates to a gas/liquid or to a gas/gas heat exchanger of the multipanel or multilayer type wherein each layer or panel consists of a plurality of mutually parallel one-piece heat conductive lamellae or ribs and which is traversed in counterflow by the two media to be placed in mutual but indirect heat exchange.

BACKGROUND OF THE INVENTION

Air/water and air/air heat exchangers of various types are, of course, known. These generally comprise plates or vanes or fins and/or pipes through which the two flows of air and/or water can be separately directed and which form respective passages or ducts for these media so that one of the media can transfer its heat to the other medium by indirect heat exchanger through the plates or fins of the heat exchanger. A high degree of heat exchanger efficiency is obtained when the two plates are passed generally in counterflow, i.e. one of the media passes from one side to the opposite side of the heat exchanger while the other medium flows from that other side toward the first-mentioned side in the respective flow passages.

All of these heat exchangers are characterized by the fact that a high degree of heat exchange can only be obtained when the heat exchanger is comparatively large. When heat exchangers are made smaller to minimize energy losses, the heat efficiency generally falls and as a result it has not been possible heretofore to satisfactorily provide a heat exchanger whose dimensions and weight are practical for all heat exchanger requirements.

Furthermore, large heat exchanger units are comparatively difficult and expensive to clean and it is commonly necessary to replace an entire heat exchanger upon the development of a defect in only a part thereof.

OBJECTS OF THE INVENTION

It is the principal object of the present invention to provide a heat exchanger which can be utilized to obtain a high degree of heat exchange efficiency and a high degree of heat exchange but which is simple and easy to repair at relatively low cost and which can be assembled and disassembled with ease.

Another object of the invention is to provide a heat exchanger which permits replacement of a part thereof in the event of development of a defect so that the entire heat exchanger need not be replaced upon such an occurrence.

Still another object of the invention is to provide an improved heat exchanger which can be accommodated more easily to particular requirements than has heretofore been the case.

Finally, it is an object of the invention to provide an improved heat exchanger which overcomes drawbacks of prior art heat exchangers.

SUMMARY OF THE INVENTION

These objects and others which will become apparent hereinafter are attained, in accordance with the invention by providing a heat exchanger for the indirect heat exchange between two fluid media in counterflow in which one set of flow passages for one medium is defined between a multiplicity of mutually parallel transversely spaced vanes which are formed in one piece and are all of the same height, while the vanes transfer heat from the medium at a higher temperature to the medium at a lower temperature and wherein the heat exchanger is subdivided into a plurality of heat exchanger layers, hereinafter referred to as heat exchanger panels, each of which constitutes or forms a complete heat exchanger independent from the other panels of the heat exchanger with passages for both media which includes a respective group of parallel heat conductive lamella or vanes which are fixed in their relationship with one another and have the same height. Each layer or panel is disposed parallel to the other layers or panels which may be coextensive in area therewith, the panels being releasably connected to adjoining panels and being independently connectable at respective inlets and outlets to the main inlet and outlet ducts of the heat exchanger as a whole for the respective media.

Each of the heat exchanger panels is thus a functionally independent heat exchanger module capable of effecting heat exchange in the counterflow principle between two fluid media and the number of modules which may be used in a particular heat exchanger assembly can be selected in accordance with the requirements at the site of use.

Since the heat exchanger as a whole can be assembled from such modules at the site, transport to the site is inexpensive and assembly at the site to a heat exchanger of the desired size and capacity poses no problem.

Maintenance is greatly simplified and can effect a laborsaving since only the defective module would be removed or cleaned while a replacement module can be inserted during the repair of the defective module so that the downtime of the heat exchanger can be minimized. In this fashion heat exchanger repair and cleaning can be greatly simplified.

Since the heat exchanger is subdivided into a multiplicity of discrete or individual layers, i.e. the panel modules, the heat exchanger can be a modular construction of such panels in a number assembled to suit the desired temperature drop in the relatively warm medium, the temperature rise in the relatively cool medium and the heat transfer between them by providing the requisite heat exchange surface area for the counterflow operation.

It has been found to be advantageous to provide the height of each lamella or vane so that it is a multiple of the spacing between the lamellae or vanes of the area of each heat exchanger panel.

This has been found to ensure that the heat transfer will be effected primarily or predominantly through heat conduction of lamellae or vanes rather than through the partitions separating the fluid medium passages. The lamella or vane thickness is so selected with respect to the particular material used for the vanes that energy loss by heat conduction is minimized.

It has been found to be advantageous to provide between each pair of adjoining panels of the heat exchanger a respective separating surface or member, hereinafter referred to as a sheet, to separate the flow of the fluid medium between the lamellae or vanes of one panel from the flow between the lamellae and vanes of the adjoining panel.

This reduces the tendency for transverse turbulence or vortex flow and keeps the pressure drop especially low. Furthermore, this also prevents condensate formed in one panel from passing into another panel and thereby increasing the pressure drop in the latter panel or module.

Especially with gas/gas heat exchangers, it has been found to be advantageuos to provide the lamellae or vanes so that they project into the regions traversed by both fluid media between which the heat exchange is to be effected. This ensures that the heat transfer will be effected practically exclusively through the lamellae or vahes, thereby keeping the energy losses especially low.

The heat flow from one medium to the other, therefore, is effected substantially exclusively through the lamellae.

BRIEF DESCRIPTION OF THE DRAWING

The above and other objects, features and advantages of the present invention will become more readily apparent from the following description, reference being made to the accompanying drawing in which:

FIG. 1 is a highly diagrammatic illustration of a gas/-liquid heat exchanger embodying the present invention;

FIG. 3 is a diagrammatic section illustrating a gas/gas heat exchanger according to the invention;

SPECIFIC DESCRIPTION

FIG. 1 shows a gas/liquid heat exchanger 1, especially an air/water heat exchanger which is traversed from right to left by the gas or air and in counterflow, i.e. generally from left to right, by the liquid or water.

For the sake of illustration, the heat exchanger 1 has been shown to have five functionally distinct modules or panels 2 in distinct layers whose height is small by comparison to the stacked height of all of the modules, i.e. to the height of the heat exchanger as a whole.

Figure 6:
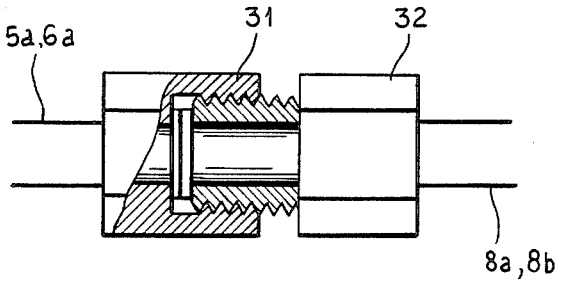
FIG. 6 is a detail view, partly in section, showing the releasable connection for a gas/liquid heat exchanger embodying the invention.

Each of the panels 2 itself constitutes a complete heat exchanger. Each panel 2 has its gas inlet and gas outlet sides, 2*a* and 2*b* connected respectively to the main supply 3 and the outlet 4 of the gas, the supply 3 and the outlet 4 being shown as triangles pointing in the direction of air flow and representing, for example, a blower or suction fan and associated ductwork well known in the heat exchanger arts. In addition, inlet and outlet fittings 8*a* and 8*b* traversed by the liquid are connected to an inlet manifold 5 and an outlet manifold 6. The means for connecting the pipe to the manifold will be described in connection with FIG. 6, but in all cases it should be apparent that the inlets and outlets for the two fluid media of the panels are separately connected to the respective supplies or discharge systems of the heat exchanger so that there is a discrete flow of the two media through each panel independently of the flows through the other panels in counterflow heat exchanging relationship.

Figure 2:
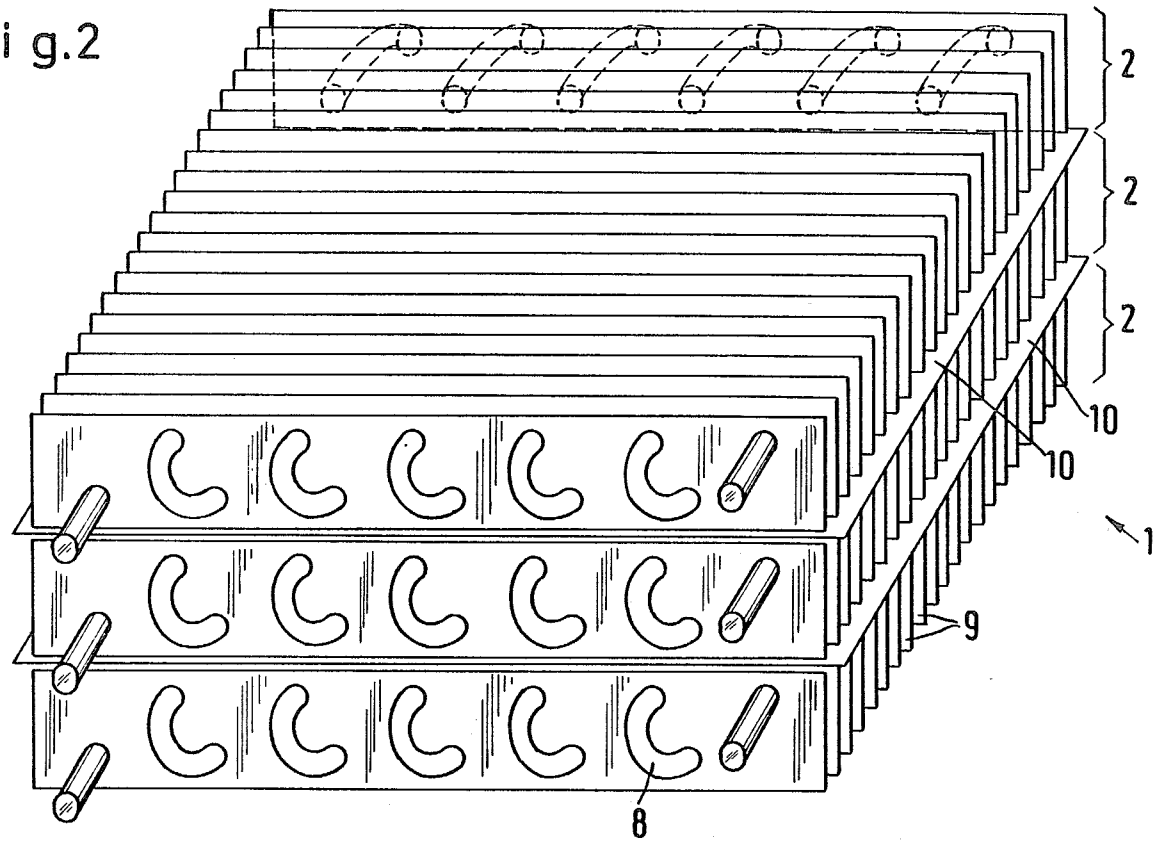
FIG. 2 is a perspective view of essential parts of this heat exchanger embodied with three panel modules.

The gas flow through each panel is represented at 7 and is linear while the liquid flow through each panel is somewhat serpentine following the serpentine pattern of the tube coil 8 within the panel (see FIG. 2).

Thus in each flow passage between the lamellae or vanes 9 of the respective panel, the liquid flow is transverse to the gas flow while the overall flow patterns of the gas and liquid media are opposite or in counterflow.

Each panel 2, therefore, consists of an array of mutually parallel transversely spaced lamellae or vanes 9, each of which is unitary and is affixed, e.g. by soldering, to the serpentine tube so that in rectilinear stretches of each tube 8 the lamellae or vanes lie perpendicular to the tube.

The serpentine tube 8, in turn, passes repeatedly through the array of lamellae of the given panel 2.

The thickness of each of the identical lamellae is selected so that with relation to the material from which it is composed there is minimal energy loss in heat conduction.

Between each pair of adjoining panels 2, parallel to the tubes 8 and to each panel, a respective partition surface or sheet 10 is provided. The sheets 10 separate the gas flows of the adjoining panels from one another.

The tube of each panel at its inlet and outlet is connected via a respective valve 11 to the respective inlet manifold 5 or outlet manifold 6 so that when each panel is placed in operation initially it can easily be vented to remove air and selected panels can be cut into operation or removed from operation and even dismounted for replacement, cleaning or repair without interrupting fluid flows through adjoining panels.

Figure 4:
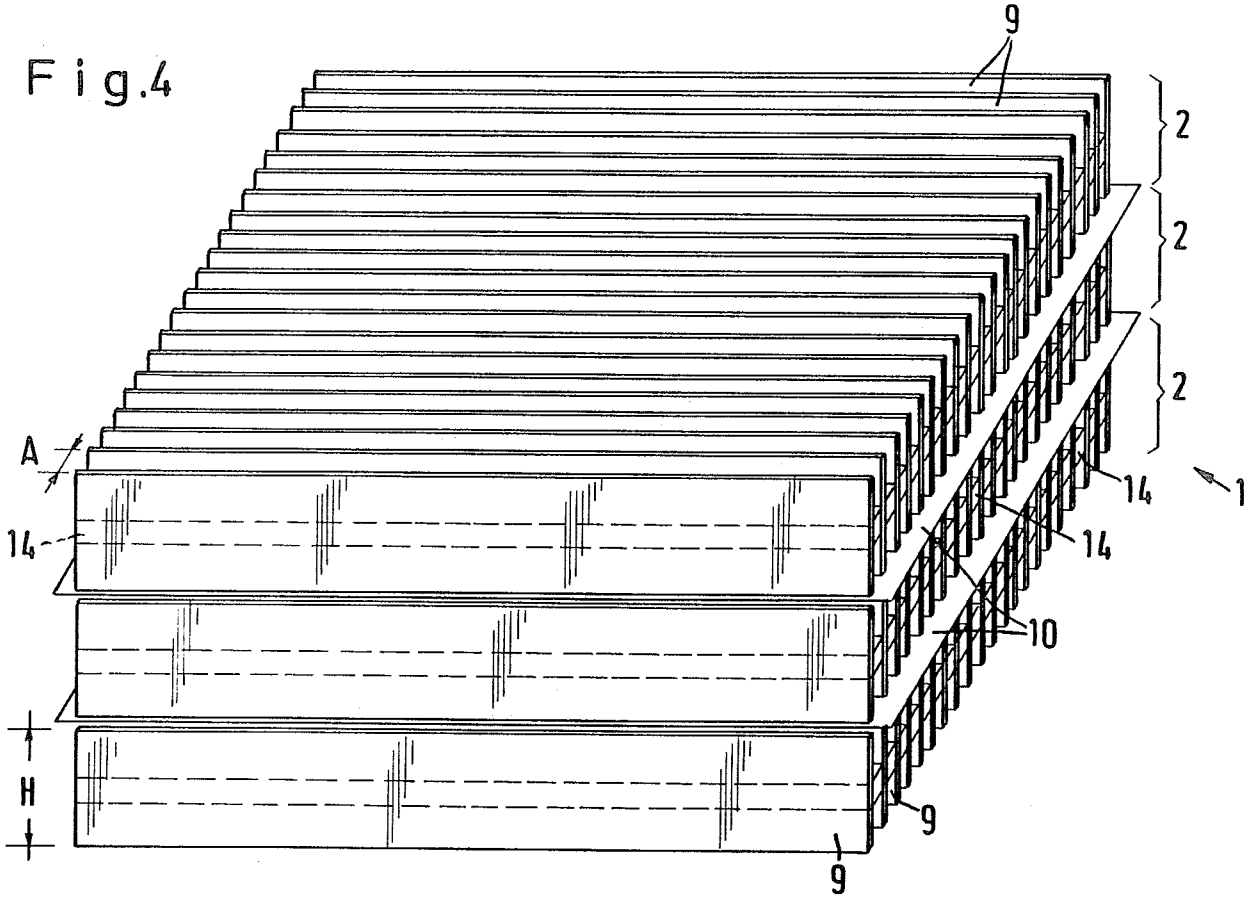
FIG. 4 is a perspective view similar to FIG. 2 but illustrating the heat exchanger of FIG. 3 with only three panel modules.

FIGS. 3 and 4 show a gas/gas heat exchanger, especially an air/air heat exchanger which is traversed from left to right by waste gas such as a flue gas or other comparatively hot medium such as heated air or even ambient air. The source of this air is represented at 12 and can represent any conventional means, e.g. a blower, for passing the comparatively warm medium through the heat exchanger.

The second gas or air stream from a source 13, which can also include a blower, is initially at a lower temperature and is heated in indirect heat exchange within the heat exchanger 1', here shown to have five individual, functionally independent and discrete heat exchanger panels 2'.

In this case, the means for feeding each gas to the respective flow passages of the respective panels comprises housing walls 20 and 21 defining a flow channel 22 traversed by the gas at the inlet side of the respective passage and guided over butterfly valves which can be closed off by rotation into a plane perpendicular to the plane of the paper but are shown in their open positions in FIG. 3.

At the outlet side of each flow passage, the walls 20 and 21 terminate in a compartment 24 into which a collecting fitting 25 of an outlet manifold 26 opens, e.g. via a check valve only schematically represented at 27. For each of the gases, a respective manifold system ZU or FO is provided, the former conducting away the now heated gas AU from the source 13 while the latter conducts away the heated gas AB from the source 12.

The walls 21 may be formed with channels engaging projecting edges of partitions 14 which will be described in greater detail below to seal the sets of flow passages from one another.

Each of the panels 2' is provided with a set of vanes or lamellae 9' as previously described, but here the lamellae are not traversed by a serpentine tube, but rather are bonded together by slabs 14*a* which are coplanar (FIG. 4) to define the partitions 14 previously mentioned.

Thus upper and lower portions of each panel are traversed by a different gaseous medium and the heat exchange between the two media is effected almost exclusively by heat conduction through the lamellae or vanes.

As in the embodiment of FIGS. 1 and 2, each panel is separately connected to the inlet and outlet means and forms a functionally complete heat exchanger between which as in FIG. 4, sheets 10 can be provided. Each lamella or vane 9 thus extends into contact with two different media. The height H of the lamellae or vanes 9 or 9' is a multiple of the distance A between lamellae or vanes.

Figure 5:
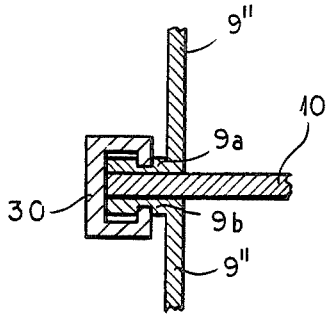
FIG. 5 is a detail section showing a simple device for connecting the adjoining panels together.

In both embodiments, the panels 2 or 2' are connected releasably to the adjoining panels so that individual panels are easily replaceable and mountable or dismountable from the heat exchanger. This can be achieved by providing, as shown in FIG. 5, the peripheral lamellae or vanes 9'' of two panels with flanges **9*a* and 9*b* which are engaged by a channel 30. The latter can be thrust over these flanges to sandwich the sheet 10 between the panels. Ease in connecting liquid lines for the individual panels can be achieved by releasable threaded couplings 31 and 32 which can press flared ends of the tube fittings 8*a*, 8*b* into engagement with fittings 5*a* or 6*a***, for example.

The heat exchanger need not only lie horizontally as has been illustrated, but can be oriented vertically and the heat exchanger efficiency has been found to be 75 to 90% with the heat exchangers illustrated when the lamellae and tubes are composed of copper.

I claim:

1. A heat exchanger for exchanging heat between a first fluid and a second fluid, at least one of the fluids being a gas, the exchanger comprising:

a plurality of identical panels each formed by a set of substantially parallel vanes, and a serpentine tube having a pair of ends and traversing the respective set of vanes and fixing same together parallel to one another to define a plurality of parallel flow passages crossing the tube and having oppositely opening passage ends, the panels being arrayed laterally atop one another in a stack with the passages parallel;

respective sheets between and laterally engaging the vanes of adjacent panels in the stack, whereby each passage is delimited by a respective two of the vanes and a respective two of the sheets;

means releasably fixing the vanes and sheets together with the panels in the stack and all the passages extending parallel to one another;

a respective tube valve at each end of each tube;

first manifold means connected to the ends of the passages for passing the first fluid therethrough; and second manifold means connected via the tube valves to the ends of the tubes for passing the second fluid therethrough countercurrent to the first fluid.

2. The heat exchanger defined in claim 1 wherein each vane has a height measured perpendicular to the respective sheets which is a multiple of the spacing between adjacent vanes of the same panel.

3. The heat exchanger defined in claim 1 wherein each panel has two edge vanes formed with outwardly bent lips lying on the respective sheets, the fixing means including clips engaging the bent lips to opposite sides of the respective sheets.

4. The heat exchanger defined in claim 1, further comprising:

a respective passage valve at each end of each passage.

* * * * *